US005313913A

United States Patent [19]

Ohshita et al.

[11] Patent Number: 5,313,913

[45] Date of Patent: May 24, 1994

[54] PRESSURIZED INTERNAL CIRCULATING FLUIDIZED-BED BOILER

[75] Inventors: Takahiro Ohshita; Shuichi Nagato, both of Yokohama; Norihisa Miyoshi, Sodegaura; Seiichiro Toyoda, Tokyo, all of Japan

[73] Assignee: Ebara Corporation, Tokyo, Japan

[21] Appl. No.: 69,686

[22] Filed: May 28, 1993

[51] Int. Cl.[5] ..... B09B 3/00; F22B 1/00

[52] U.S. Cl. ..... 122/4 D; 60/39.464; 110/245; 422/146

[58] Field of Search ..... 122/4 D; 60/39.464; 110/245; 422/146

[56] References Cited

U.S. PATENT DOCUMENTS

| | | | |
|---|---|---|---|
| 4,655,147 | 4/1987 | Brännström et al. | 110/263 |
| 4,823,740 | 4/1989 | Ohshita et al. . | |
| 4,938,170 | 7/1990 | Ohshita et al. . | |
| 5,052,344 | 10/1991 | Kosugi et al. . | |
| 5,138,982 | 8/1992 | Ohshita et al. . | |
| 5,146,856 | 9/1992 | George | 122/4 D X |
| 5,156,099 | 10/1982 | Ohshita et al. . | |
| 5,163,384 | 11/1992 | Brännström et al. | 122/4 D |

OTHER PUBLICATIONS

"PFBC and a new era for coal arise from mothballed plant", Journal of POWER, Apr. 1991, pp 102–108.

F. L. Kinsinger, "PFBC System Modularity", Journal of Proceedings of the American Power Conference, pp. 646–650 no date.

Reiji Ishimoto et al., "Practical Use of IHI's Pressurized Fluidized-Bed Boiler", Technical New published by Ishikawajima Harima Industry Co., Sep. 1991, vol. 31-5, pp. 301–308.

Shigeru Ishigaki et al., "The present technique of Pressurized Fluidized Bed", Journal of Chemical Devices, Feb. 1991, pp. 51–58.

*Primary Examiner*—Edward G. Favors

*Attorney, Agent, or Firm*—Wenderoth, Lind & Ponack

[57] ABSTRACT

A pressurized internal circulating fluidized-bed boiler is incorporated in a combined-cycle electric generating system in which a fuel such as coal, petro coke or the like is combusted in a pressurized fluidized bed and an exhaust gas produced by the combusted fuel is introduced into a gas turbine. The pressurized internal circulating fluidized-bed boiler includes a pressure vessel, a combustor disposed in the pressure vessel and a primary fluidized bed incinerating chamber provided with an air diffusion device. A thermal energy recovery chamber is partitioned from the primary fluidized bed incinerating chamber by an inclined partition wall. A fluidizing medium flows into and out of the primary incinerating chamber and the thermal energy recovery chamber.

10 Claims, 15 Drawing Sheets

*FIG. 4*

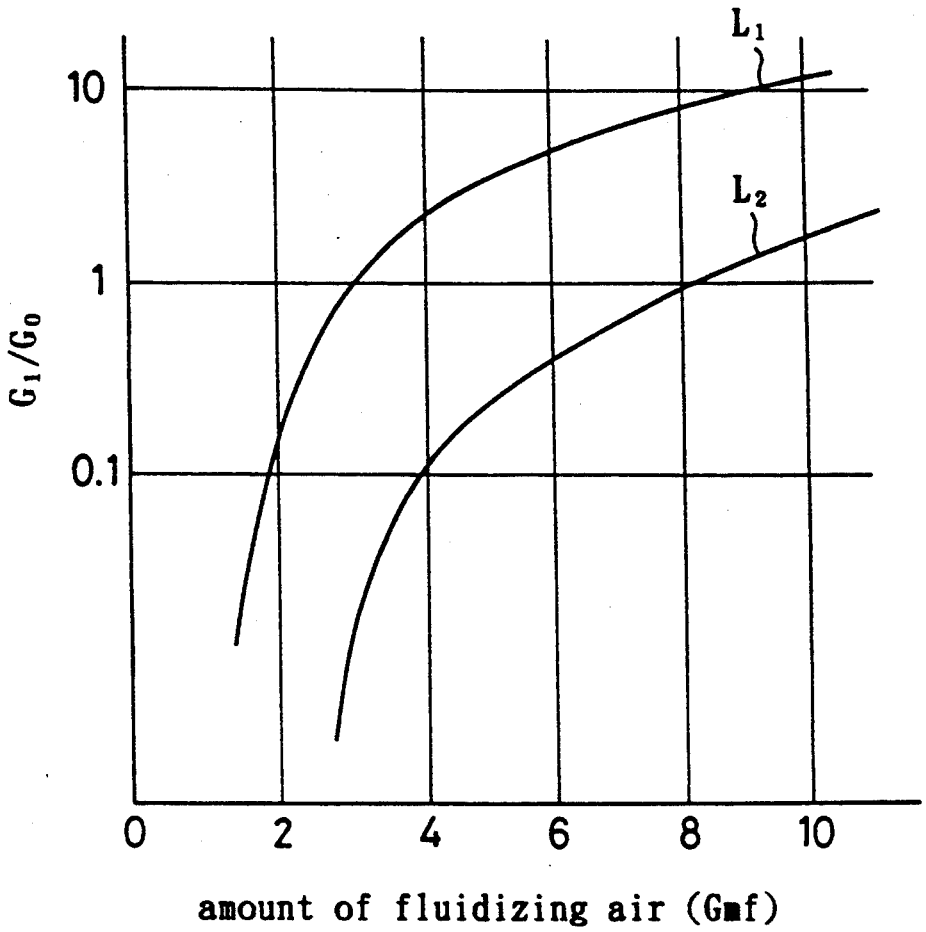

NOTE

Gmf minimum mass flow for fluidization $G_1$ recycling amount of fluidizing medium $L_1$ The case where height of fluidized bed reaches upper end of inclined partition wall without injecting fluidizing air into bed $L_2$ The case where height of fluidized bed in incinerating portion is approximately at upper end of partition wall with injecting fluidizing air into bed $G_0$ Recycling amount of fluidizing medium in case of $L_1$ with fluidizing air mass flow at lower end of inclined partition wall 3Gmf in incinerating chamber

PRESSURIZED INTERNAL CIRCULATING FLUIDIZED-BED BOILER

BACKGROUND OF THE INVENTION

1. Field of the Invention

The present invention relates to a pressurized internal circulating fluidized-bed boiler, and more particularly to a pressurized internal circulating fluidized-bed boiler for use in a pressurized fluidized-bed combined-cycle electric generating system in which a fuel such as coal, petro coke, or the like is combusted in a pressurized fluidized bed and an exhaust gas produced by the combusted fuel is introduced into a gas turbine.

2. Description of the Prior Art

Efforts to reduce the emission of carbon dioxide from various sources are important in view of environmental damages that are being caused by air pollution which appears to be more and more serious on the earth. It is conjectured that coal will have to be relied upon as a major energy resource because greater dependency on nuclear and oil energies is not favorable at present. To suppress carbon dioxide emission and provide a substitute for oil and nuclear power, there has been a demand for a highly efficient, compact electric generating system which is capable of utilizing coal combustion to generate a clean energy.

To meet such a demand, atmospheric fluidized-bed boilers (AFBC) capable of burning coals of different kinds for electric generation have been developed because a stable energy supply cannot be achieved by pulverized coal boilers which pose a limitation on available coal types.

However, the atmospheric fluidized-bed boilers (AFBC) fail to perform the functions that have been expected. In addition, since only steam turbines can be combined with the atmospheric fluidized-bed boilers, there are certain limitations on attempts to increase the efficiency and energy output of the atmospheric fluidized-bed boilers. These disadvantages of the atmospheric fluidized-bed boilers have directed research and development trends toward pressurized fluidized-bed boilers (PFBC) that make it possible to construct combined-cycle electric generating systems with gas turbines.

One combined-cycle electric generating system which incorporates a conventional pressurized fluidized-bed boiler will be described below with reference to FIG. 15 of the accompanying drawings.

As shown in FIG. 15, a pressure vessel 30 houses therein a combustor 31 which is supplied at its bottom with air under pressure from a compressor 32. The pressure vessel 30 also accommodates a bed material storage container 33 which communicates with the combustor 31 to allow a fluidizing medium to move between the combustor 31 and the bed material storage container 33. The combustor 31 has a heat transfer tube 34 disposed therein which is connected to a steam turbine 35.

A dust collector 36 is positioned adjacent and connected to an upper portion of the combustor 31. Dust particles contained in an exhaust gas discharged from the combustor 31 are removed by the dust collector 36. Thereafter, the exhaust gas is supplied to a gas turbine 37.

Operation of the pressurized fluidized-bed electric generating system shown in FIG. 15 is as follows:

Coal is roughly crushed and supplied, together with a desulfurizer such as limestone, to the combustor 31. In the combustor 31, there is generated a fluidized bed, about four meters high, by air supplied under pressure from the compressor 32, the fluidized bed being composed of a fluidizing medium comprising a mixture of a bed material, coal, a desulfurizer, ash, etc. The coal is mixed with air in the fluidized bed, and combusted under pressure. Heat generated in the fluidized bed is recovered as steam by the heat transfer tube 34 in the fluidized bed. The steam is supplied from the heat transfer tube 34 to the steam turbine 35, which is rotated to actuate an electric generator coupled thereto.

The exhaust gas produced by the combustion of the coal in the combustor 31 is supplied to the dust collector 36, which removes dust particles from the exhaust gas. The exhaust gas is then supplied from the dust collector 36 to the gas turbine 37, which actuates the compressor 32. Residual energy contained in the exhaust gas actuates an electric generator coupled to the gas turbine 37.

The exhaust gas discharged from the outlet of the gas turbine 37 is supplied to a denitrification unit 45 which reduces the NOx content and smoke dust in the exhaust gas. The waste heat of the exhaust gas is then recovered by an economizer 38. Thereafter, the exhaust gas is discharged from a smoke stack 39.

The pressurized fluidized-bed electric generating system shown in FIG. 15 is controlled to meet a load imposed thereon by varying the height of the fluidized bed in the combustor 31. More specifically, the fluidizing medium is drawn from the combustor 31 into the bed material storage container 33 to expose heat transfer surfaces of the heat transfer tube 34, thereby controlling the heat generation to meet the load. When the heat transfer surfaces of the heat transfer tube 34 are exposed, the heat transfer coefficient thereof is lowered, and hence the amount of heat recovered is lowered. Since the exhaust gas emitted from the fluidized bed is cooled by the exposed heat transfer surfaces, the temperature of the exhaust gas supplied to the gas turbine 37 is lowered, thus reducing the output energy of the gas turbine 37. However, the above control process is disadvantageous in that the bed material storage container 33 is necessary to withdraw and return the high-temperature fluidizing medium from and into the combustor 31, it is not easy to withdraw and return the fluidizing medium at high temperature and pressure, and agglomeration tends to occur when the fluidizing medium particles of high heat density are taken into and out of the bed material storage container 33.

Furthermore, since the pressurized fluidized-bed boiler is under pressure, the heat transfer tube 34 in a splash zone of the fluidized bed is more subject to wear than that in the atmospheric fluidized-bed boilers. Another problem is that an large amount of carbon monoxide is produced because the exhaust gas emitted from the fluidized bed is cooled by the heat transfer tube 34 and the exhaust gas remains in the fluidized bed for a short period of time as the height of the fluidized bed is reduced.

As described above, limestone is mixed with the fluidizing medium for desulfurization in the conventional pressurized fluidized-bed electric generating system shown in FIG. 15. However, the limestone wears rapidly, and is scattered as ash from the dust collector 36 without sufficiently contributing to the desulfurizing action. The conventional pressurized fluidized-bed electric generating system fails to achieve a high desulfurization rate that are required by thermal power plants. If the desulfurization rate is increased, then the conventional pressurized fluidized-bed electric generating system produces a vast amount of scattered ash.

SUMMARY OF THE INVENTION

It is therefore an object of the present invention to provide a pressurized internal circulating fluidized-bed boiler for a combined-cycle electric generating system, which can be controlled to meet a load without varying the height of a fluidized bed, minimizes the generation of agglomeration and carbon monoxide, and can increase a limestone utilization ratio and a desulfurization rate.

According to the present invention, there is provided a pressurized internal circulating fluidized-bed boiler for use in a combined-cycle electric generating system, comprising: a pressure vessel; a combustor disposed in said pressure vessel; a primary fluidized bed incinerating chamber having an air diffusion device provided at the bottom of said combustor and adapted to inject fluidizing air upwardly under a mass flow that is at least greater at one side than that at another side; an inclined partition wall provided above a portion of said air diffusion device where the mass flow is greater so as to interfere with the upward flow of the fluidizing air and thereby to deflect the air towards a portion above said another side of said air diffusion device where the mass flow is smaller; a thermal energy recovery chamber partitioned from said incinerating chamber by said inclined partition wall; a heat transfer surface means provided in said thermal energy recovery chamber for a passage of a heat receiving fluid therethrough; and an air diffuser provided at a lower portion of said thermal energy recovery chamber; wherein said thermal energy recovery chamber is communicated at upper and lower portions thereof with said primary fluidized bed incinerating chamber, a moving bed is formed above the portion of said air diffusion device where the injected mass flow is smaller so that a fluidizing medium descends and diffuses within the moving bed, and a circulating fluidized bed is formed above the portion of said air diffusion device where the mass flow of the fluidizing air is greater so that said fluidizing medium is actively fluidized and whirled towards a position above said moving bed and a part of said fluidizing medium is introduced into said thermal energy recovery chamber beyond an upper portion of said inclined partition wall, the formation of said moving bed and said circulating fluidized bed is effected by regulation of the amount of air injected upwardly from said air diffusion device and regulation of the fluidizing air injected from said air diffuser in said thermal energy recovery chamber causes the fluidizing medium within said recovery chamber to descend in a state of a moving bed for circulation.

With the above arrangement of the present invention, since the incinerating chamber and the thermal energy recovery chamber are functionally separated from each other within the combustor, the boiler can be controlled to meet a load simply by varying the overall heat transfer coefficient of the heat transfer tubes through adjustment of the amount of air introduced into the thermal energy recovery chamber, rather than by varying the height of the fluidized bed in the incinerating chamber. Therefore, no complex process and equipment is necessary to take the fluidizing medium into and out of the incinerating chamber and the thermal energy recovery chamber, and no agglomeration is generated as the fluidizing medium flows into and out of the incinerating chamber and the thermal energy recovery chamber. Since the temperature of the fluidized bed is kept at a constant level even when the load on the boiler varies, the boiler can be operated under a temperature condition optimum for the suppression of NOx, SOx, and other undesirable emissions. Inasmuch as the heat transfer tubes are positioned only in the thermal energy recovery chamber which is exposed to a gradual flow of the fluidizing medium, the heat transfer tubes are less subject to wear than would be if they were placed in the fluidized bed which is in a violent flow condition.

As swirling flows are developed in the fluidized bed, the fluidizing medium does not stay stagnant in the fluidized bed, and the fuel such as coal or petro coke is uniformly dispersed and combusted, with no agglomeration produced. The amount of carbon monoxide produced is kept low because the exhaust gas emitted from the fluidized bed is not cooled by the heat transfer tubes in the fluidized bed.

The above and other objects, features, and advantages of the present invention will become apparent from the following description when taken in conjunction with the accompanying drawings which illustrate preferred embodiments of the present invention by way of examples.

BRIEF DESCRIPTION DRAWINGS

FIG. 4 is a graph showing the relationship between the amount of air for fluidization (Gmf) at the portion below the inclined partition wall in the primary fluidized bed incinerating chamber and the amount of the fluidizing medium circulated;

DETAILED DESCRIPTION OF THE PREFERRED EMBODIMENT

Figure 1:
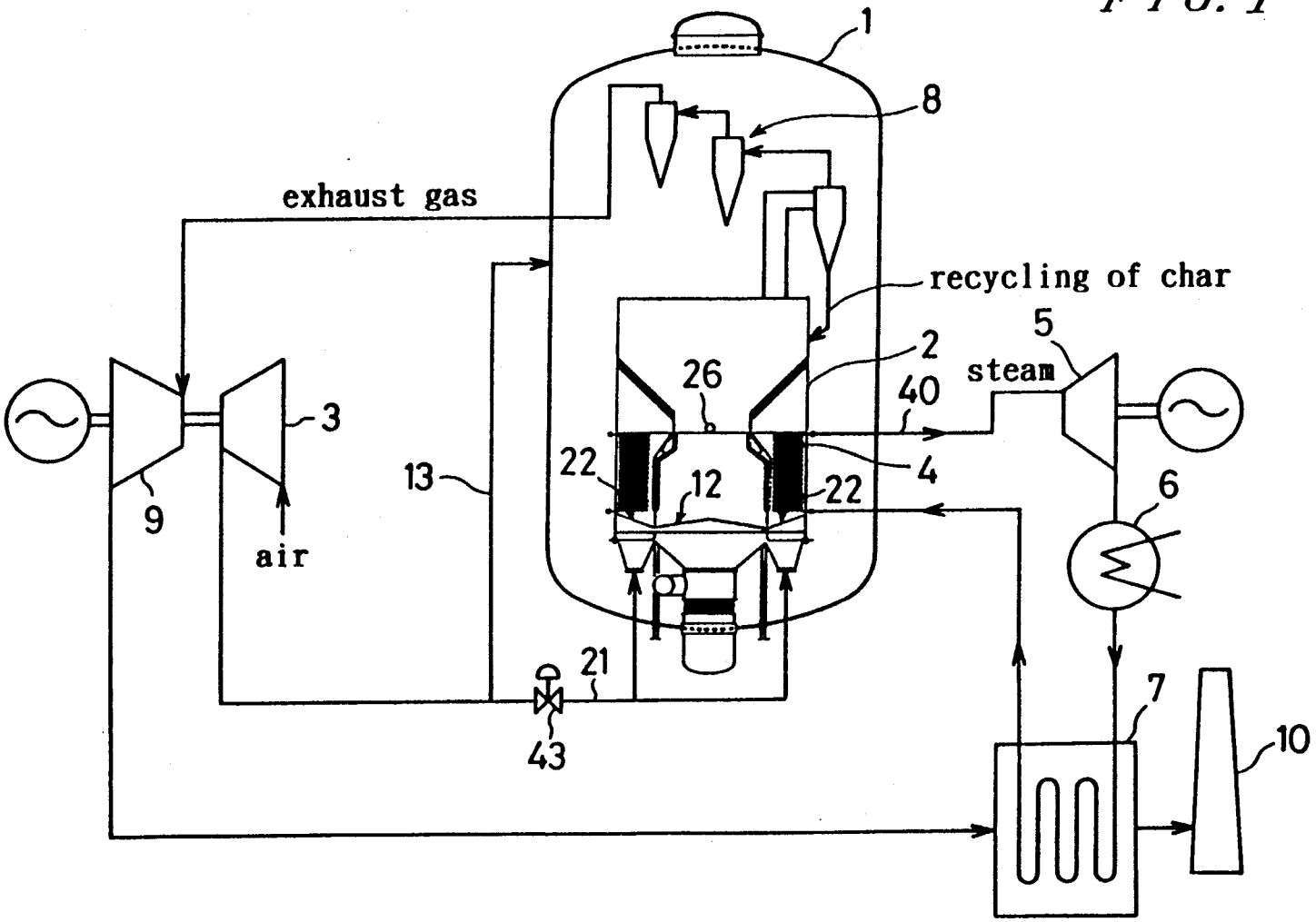
FIG. 1 is a schematic view of a combined-cycle electric generating system which incorporates a pressurized internal circulating fluidized-bed boiler according to an embodiment of the present invention.

FIG. 1 schematically shows a combined-cycle electric generating system which incorporates a pressurized internal circulating fluidized-bed boiler according to the present invention. As shown in FIG. 1, the combined-cycle electric generating system includes a pressure vessel I housing a combustor 2 therein. The pressure vessel 1 communicates with a compressor 3 which keeps a predetermined pressure in the pressure vessel 1. The combustor 2 accommodates heat transfer tubes 4 connected to an inlet of a steam turbine 5 whose outlet is coupled to the heat transfer tubes 4 through a condenser 6 and an economizer 7. The heat transfer tubes 4, the steam turbine 5, the condenser 6, and the economizer 7 jointly constitute a steam cycle system.

An exhaust gas is discharged from an upper end of the combustor 2 and introduced into a gas turbine 9 through a multistage dust collector 8. The exhaust gas discharged from the gas turbine 9 is supplied to an economizer 7 for heat recovery, and then discharged from a smoke stack 10. Ash, char, fine lime particles or the like collected by the first stage of the dust collector 8 are returned to a free board section of the combustor 2.

Figure 2:
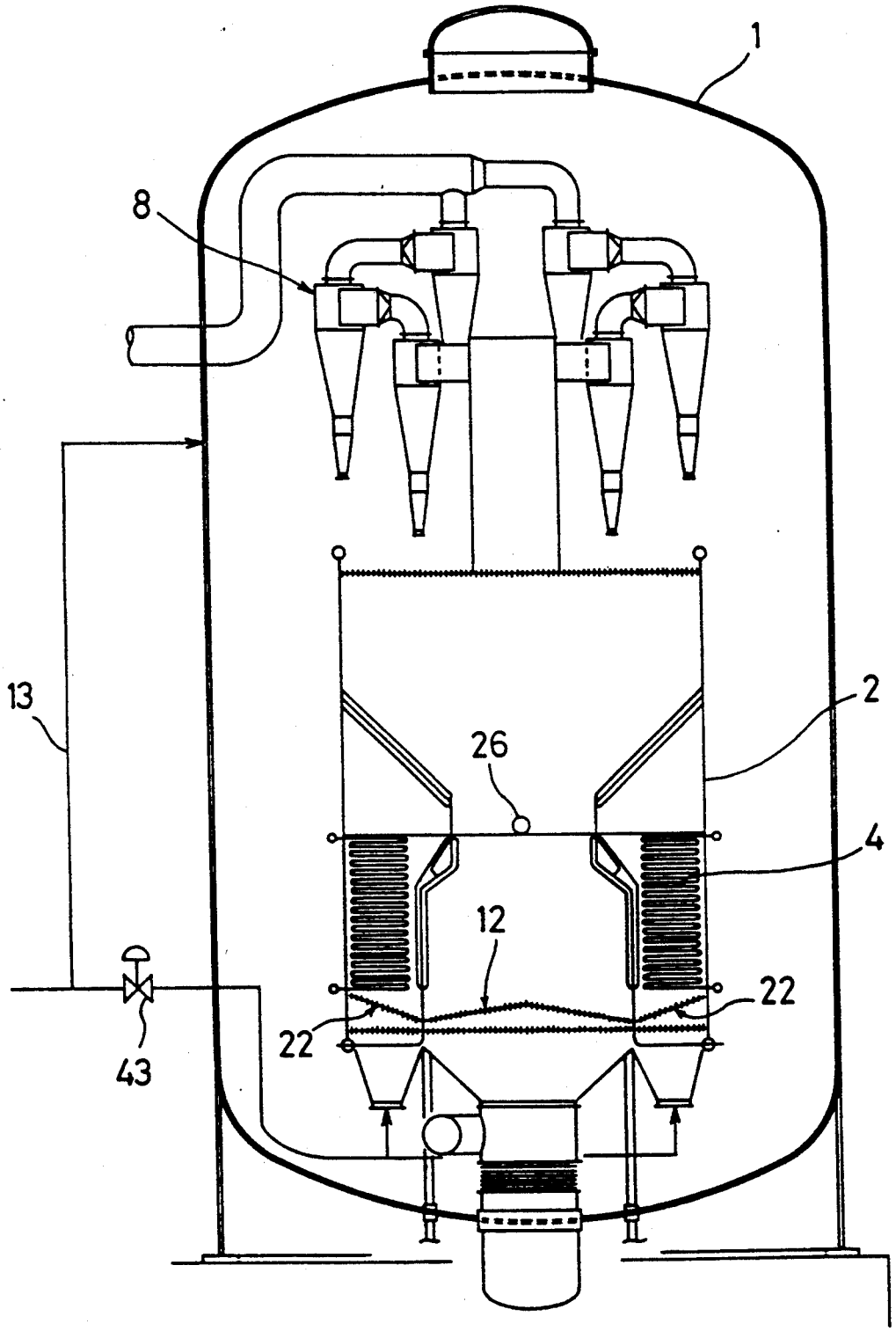
FIG. 2 is a cross-sectional view of the pressurized internal circulating fluidized-bed boiler.

The pressurized internal circulating fluidized-bed boiler will be described in detail below with reference to FIGS. 2 and 3.

Figure 3:
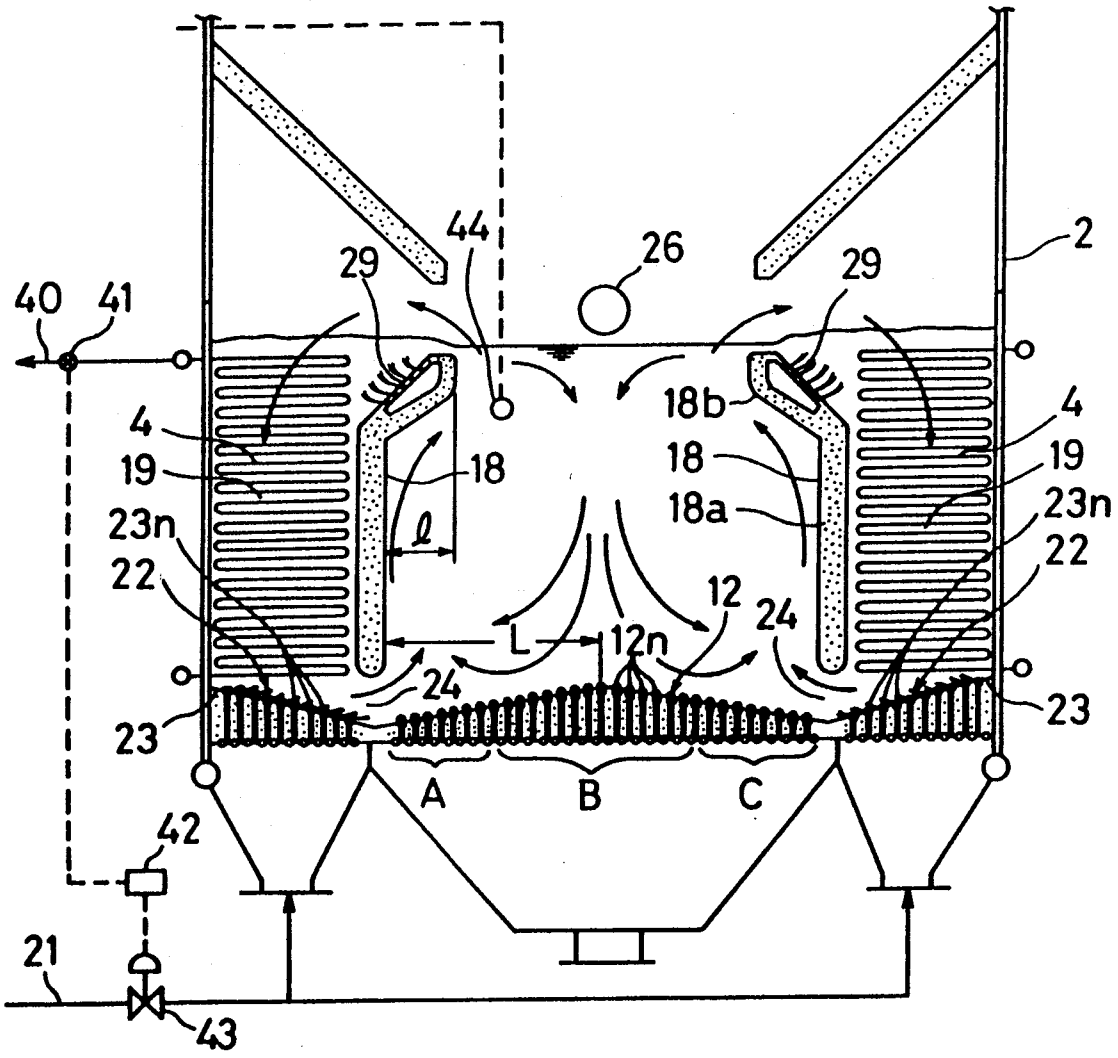
FIG. 3 is a cross-sectional view showing the detailed structure of the pressurized internal circulating fluidized-bed boiler.

As shown in FIG. 3, the combustor 2 houses a fluidizing air diffusion device 12 composed of a horizontal array of fluidizing air nozzles 12*n* on the bottom of the combustor 2. The fluidizing air diffusion device 12 has opposite side portions A, C lower than a central portion B thereof. These side and central portions A, B, C are jointly of a roof shape which is symmetrical with respect to a vertical central axis of the combustor 2. Fluidizing air is supplied from the compressor 3 through a fluidizing air conduit 21 to the fluidizing air nozzles 12*n*, from which the fluidizing air is ejected upwardly into the combustor 2. The mass flow of the fluidizing air ejected from the air nozzles 12*n* of the side portions A, C of the fluidizing air diffusion device 12 is a speed high enough to form a fluidized bed of a fluidizing medium in the combustor 2. The mass flow of the fluidizing air ejected from the air nozzles 12*n* of the central portion B of the fluidizing air diffusion device 12 is smaller than the mass flow of the fluidizing air ejected from the air nozzles 12*n* of the side portions A, C of the fluidizing air diffusion device 12.

A partition wall 18 is disposed slightly above the respective opposite ends of the fluidizing air diffusion device 12. The partition wall 18 defines a primary incinerating chamber in the combustor 2. The partition wall 18 comprises a vertical partition wall 18*a* and an inclined partition wall 18*b*. The inclined partition wall 18*b* serves as a reflective wall for reflecting the fluidizing air ejected from the air nozzles 12*n* of the side portions A, C toward the center of the combustor 2. Because of the inclined partition wall 18*b* and the difference between the mass flows of the ejected fluidizing air, swirling flows of the fluidizing medium are developed in the combustor 2 as indicated by the arrows in FIG. 3. A thermal energy recovery chamber 19 is defined between the back of the partition wall 18 and the wall of the combustor 2. While the combustor 2 is in operation, a part of the fluidizing medium flows over the upper edge of the inclined partition wall 18*b* into the thermal energy recovery chamber 19. The heat transfer tubes 4 are disposed in the thermal energy recovery chamber 19 for recovering thermal energy from the fluidizing medium flowing downwardly in the thermal energy recovery chamber 19 through a heat exchange with the fluidizing medium.

The inclined partition wall 18*b* is inclined to the horizontal plane by an angle in the range of from 10° to 60° preferably 25° to 45°. The horizontal length 1 of the inclined partition wall 18*b* as it is projected onto the bottom of the incinerator is in the range of from 1/6 to ½, preferably from ¼ to ½, of the horizontal length L of the bottom of the incinerator.

Figure 12:
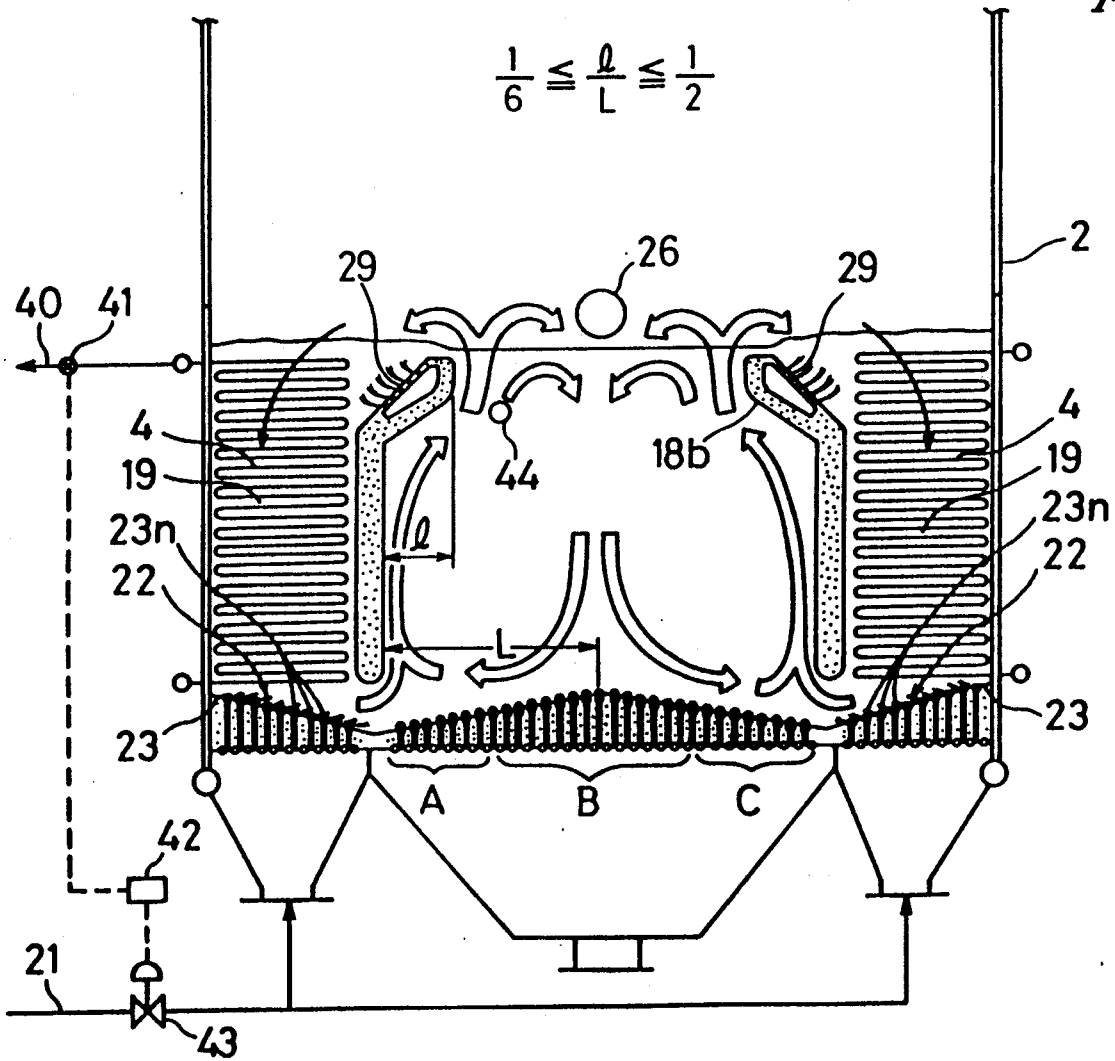
FIG. 12 shows a fluidizing pattern in the primary fluidized bed incinerating chamber with the relationship between the horizontal length L of the incinerator bottom and the projection length of the inclined partition wall in the horizontal direction.

The angle of inclination of the inclined partition wall 18*b* to the horizontal plane and the horizontal length l of the inclined partition wall 18*b* as it is projected onto the bottom of the incinerator affect the fluidized state of the fluidizing medium in the primary incinerating chamber in the incinerator and the amount of particles that enter the thermal energy recovery chamber 19. The lengths L, l and the flow of the fluidizing medium are shown in FIG. 12.

If the angle of inclination of the inclined partition wall 18*b* to the horizontal plane were smaller than 10° or larger than 60°, then no good swirling flows would be created, and the fuel such as coal would not be combusted well. The angle of inclination of the inclined partition wall 18*b* to the horizontal plane should preferably be in the range of from 25° to 45°, and more preferably be about 35°.

Figure 13:
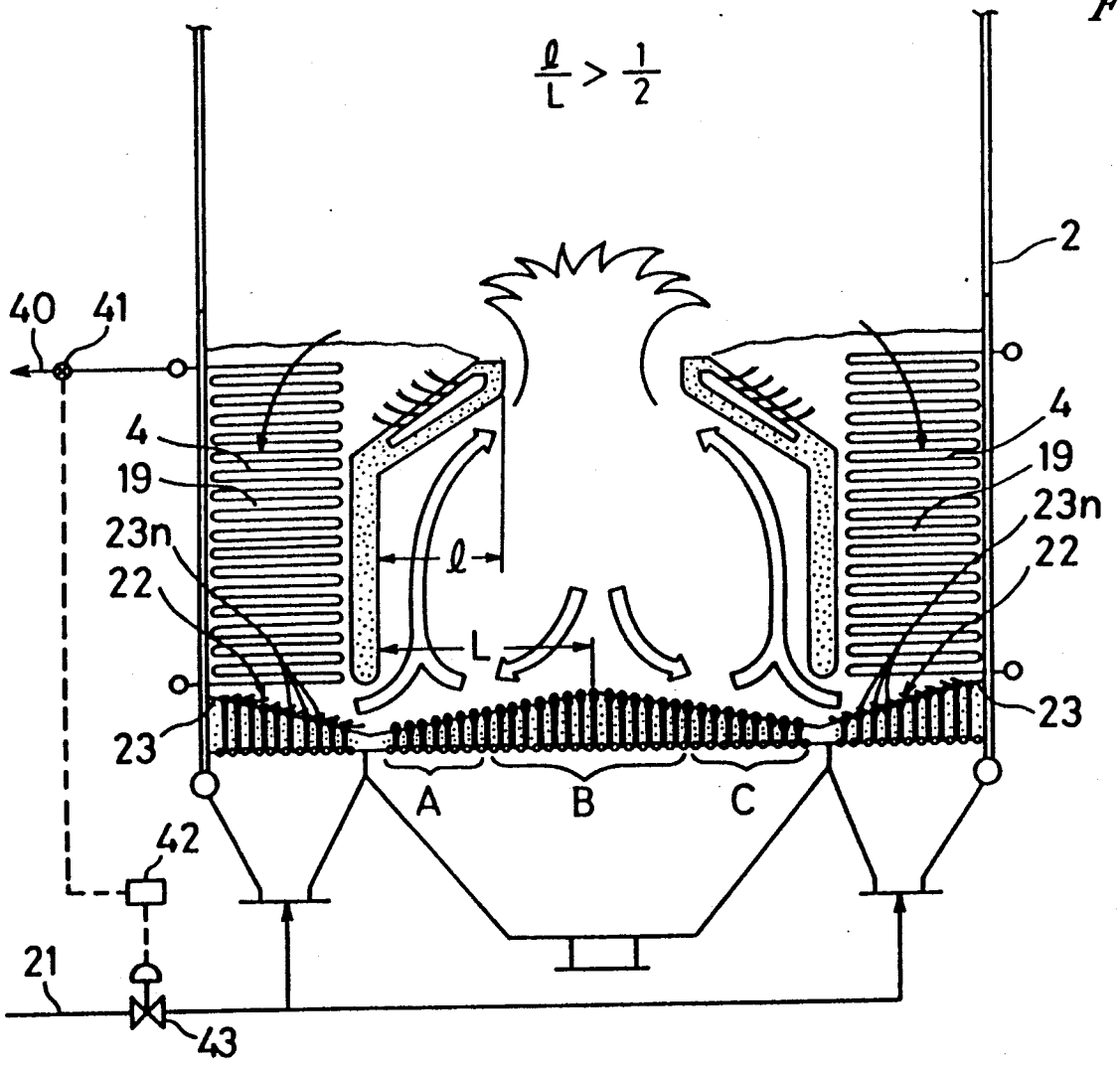
FIG. 13 shows a fluidizing pattern in the primary fluidized bed incinerating chamber with the relationship between the horizontal length L of the incinerator bottom and the projection length of the inclined partition wall in the horizontal direction.
Figure 14:
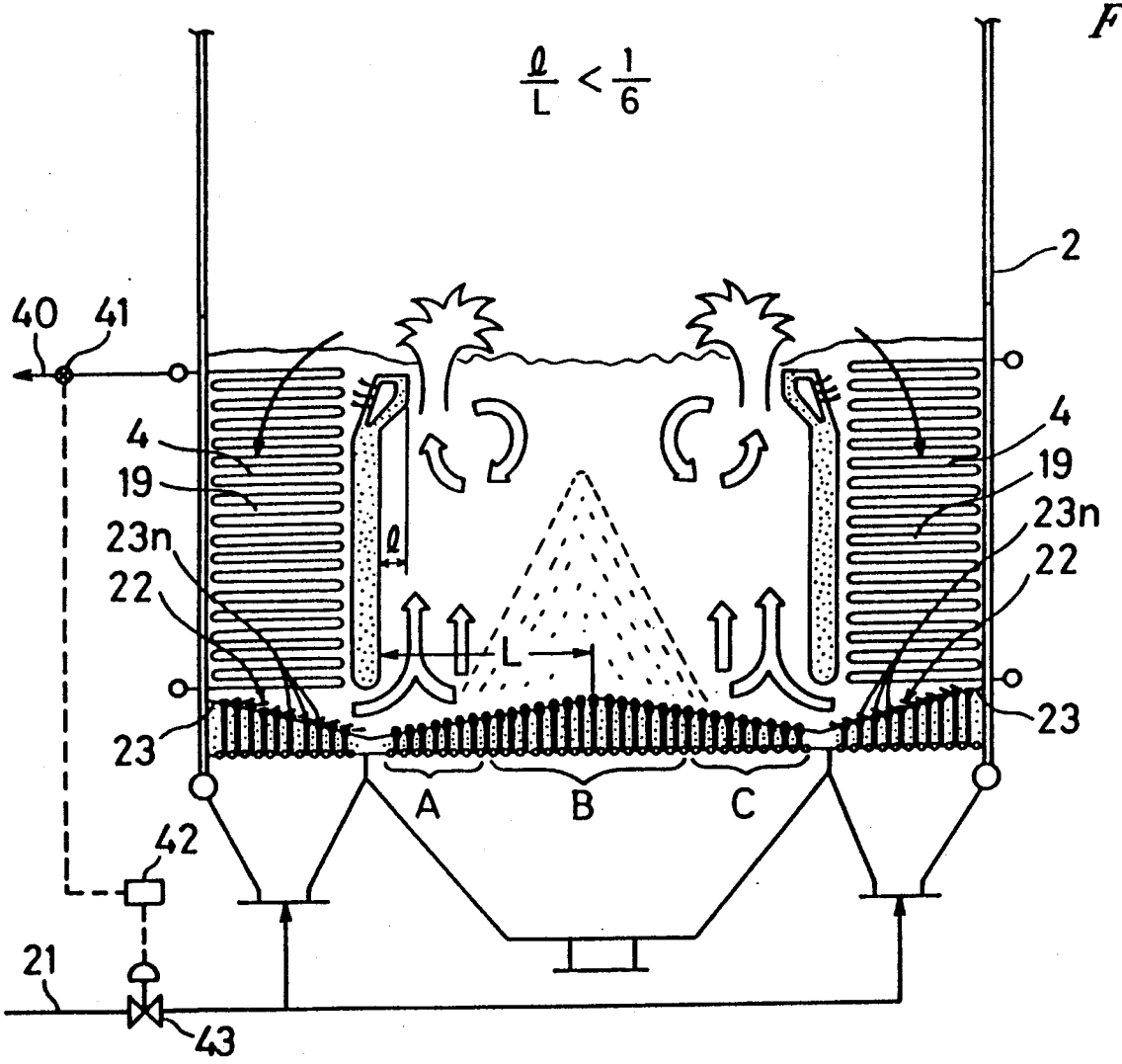
FIG. 14 shows a fluidizing pattern in the primary fluidized bed incinerating chamber with the relationship between the horizontal length L of the incinerator bottom and the projection length of the inclined partition wall in the horizontal direction.
Figure 15:
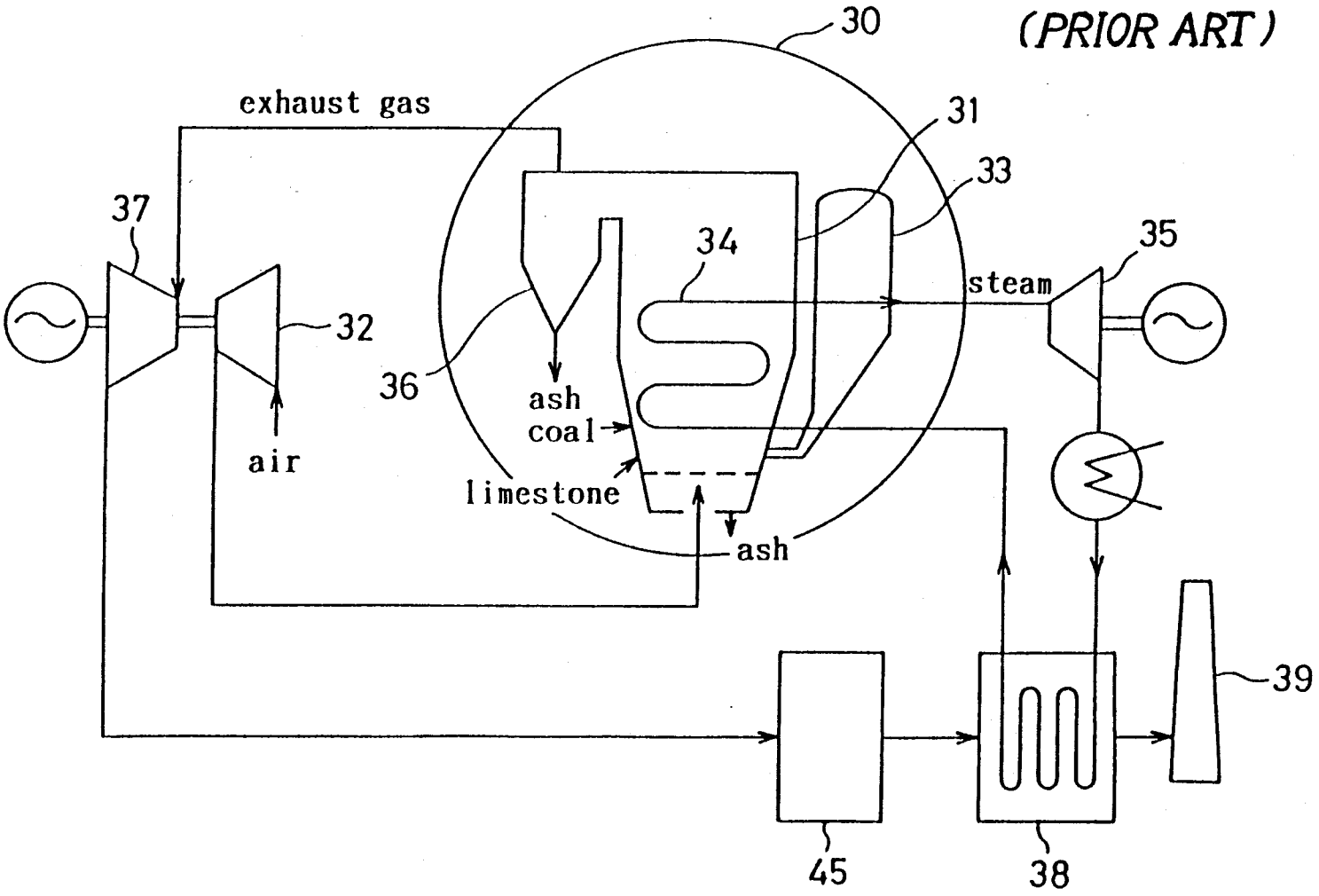
FIG. 15 (PRIOR ART)
FIG. 15 is a schematic view of a conventional combined-cycle electric generating system which incorporates a pressurized fluidized-bed boiler.

If the horizontal length l of the inclined partition wall 18*b* as it is projected onto the bottom of the incinerator were greater than ½ of the horizontal length L of the bottom of the incinerator, then the fluidizing medium reflected back by the inclined partition wall 18*b* would be blown up as shown in FIG. 13. Since the fuel would also be blown up, the fuel charged in the primary incinerating chamber would not be burned effectively.

If the horizontal length l of the inclined partition wall 18*b* as it is projected onto the bottom of the incinerator were smaller than 1/6 of the horizontal length L of the bottom of the incinerator, then the swirling flows of the fluidizing medium in the primary incinerating chamber would be deteriorated, and the moving bed in the central region of the incinerator would not be formed sufficiently. The fuel entraining and diffusing effect would be impaired, and the fluidizing medium would not sufficiently be deflected into the thermal energy recovery chamber 19.

An air diffuser 22 is disposed in a lower portion of the thermal energy recovery chamber 19 for introducing a gas or air from the compressor 3 through a conduit 21 into the thermal energy recovery chamber 19. As shown in FIG. 3, the air diffuser 22 comprises an inclined plate 23 having an array of nozzles 23*n*, the inclined plate 23 being progressively inclined outwardly toward the wall of the combustor 2. An opening 24 is defined near the air diffuser 22 vertically between the lower end of the partition wall 18 and the inner end of the air diffuser 22. The fluidizing medium that has entered the thermal energy recovery chamber 19 descends therein while forming a moving bed continuously or intermittently depending on the operating condition of the boiler, and is circulated through the opening 24 into the primary incinerating chamber.

Another air diffuser 29 is mounted on the back of the inclined partition wall 18*b* in an upper portion of the thermal energy recovery chamber 19. The air diffuser 29 ejects air to blow, combust, agitate, and diffuse the coal that has entered the thermal energy recovery chamber 19. No heat transfer tubes are located in the vicinity of the air diffuser 29, i.e., the air diffuser 29 is positioned remotely from the heat transfer tubes 4.

Figure 5:
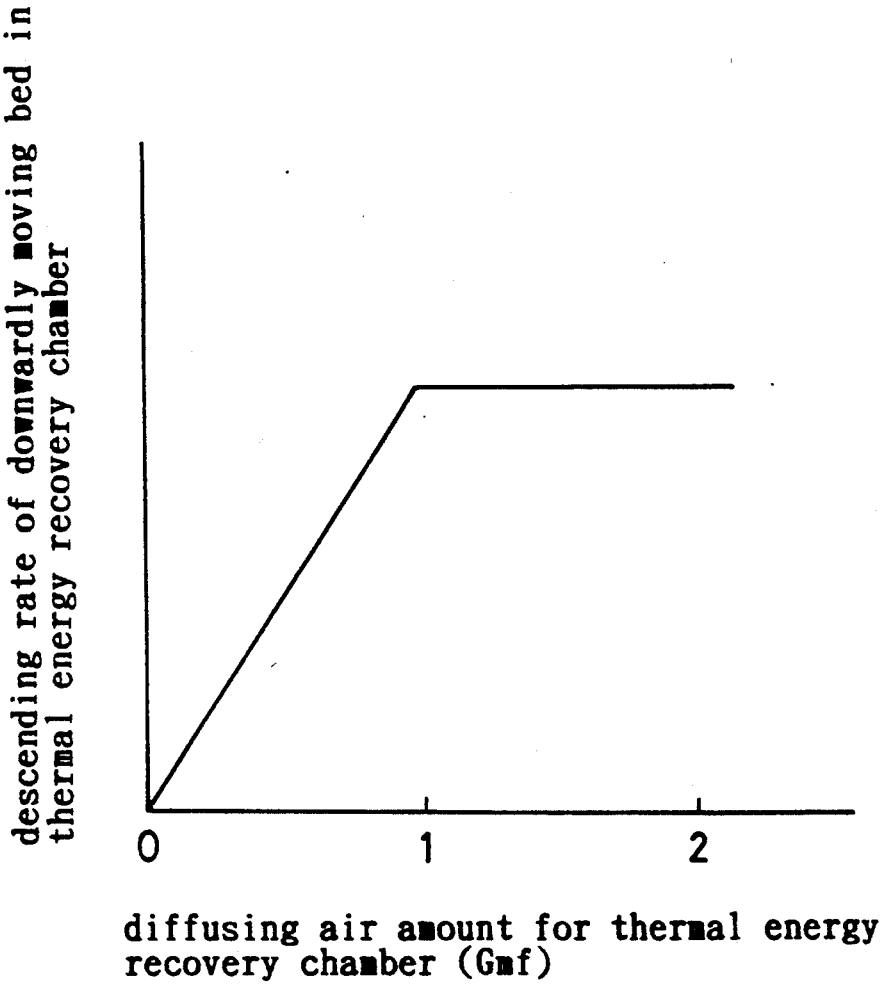
FIG. 5 is a graph showing the relationship between the amount of diffusing air (Gmf) in the thermal energy recovery chamber and the descending rate of the downward moving bed in the thermal energy recovery chamber.

The descending amount of the fluidizing medium in the thermal energy recovery chamber 19 for circulating is regulated by the amount of diffusing air for the thermal energy recovery chamber and the amount of fluidizing air for the incinerating portion. That is, the amount of fluidizing medium ($G_1$) introduced into the terminal energy recovery chamber 19 is increased as shown in FIG. 4 when the amount of fluidizing air injected from the air diffusion device 12, particularly the amount of fluidizing air injected from the nozzles 12*n* disposed on both side portions A, C is increased. Further, as shown in FIG. 5, the amount of fluidizing medium descending in the thermal energy recovery chamber 19 is approximately proportionally changed with respect to the change in the amount of diffusing air blown into the thermal energy recovery chamber 19 when the amount of diffusing air for the thermal energy recovery chamber is in the range of 0–1 Gmf. The amount of fluidizing medium descending in the thermal energy recovery chamber 19 becomes approximately constant when the amount of diffusing air for the thermal energy recovery chamber is beyond 1 Gmf. This constant amount of fluidizing medium is almost equivalent to the amount of fluidizing medium ($G_1$) introduced into the thermal energy recovery chamber and thus the amount of fluidizing medium descending in the thermal energy recovery chamber becomes equivalent to a value corresponding to $G_1$. By controlling the air amount both for the incinerating portion and the recovery chamber, the descending amount of fluidizing medium in the thermal energy recovery chamber 19 may be regulated.

The descent of the fluidizing medium in the static bed in the range of 0–1 Gmf depends on the weight difference (the difference in height of the fluidized beds) between the fluidizing medium in the thermal energy recovery chamber and the fluidizing medium in the primary fluidized bed incinerating chamber. In the case where the mass flow is over 1 Gmf, the height of the moving bed portion becomes slightly higher or approximately equal to the other.

The circulating of the fluidizing medium is assisted by a deflecting flow with a sufficient amount of fluidizing medium caused by the inclined partition wall.

Now, the relationship between the height of the fluidized bed and the circulating amount of the fluidizing medium (the deflecting flow) will be explained in detail.

In the case where the surface of the fluidized bed is lower than the upper end of the inclined partition wall, the air flow moving upwardly along the inclined partition wall is given its direction by the inclined partition wall, flows along the inclined partition wall and is injected from the fluidized bed, whereby the fluidizing medium is accompanied therewith. The injected air flow is put in a state different from that in the fluidized bed and freed from the fluidizing medium with which the fluidized bed is filled. Thereafter the sectional area of the air flowing passage is suddenly enlarged, the injected air flow is diffused and reduces its speed to a few m/s to thus become a gentle flow, and is discharged upwardly. Therefore, the fluidizing medium accompanied by the injected air flow loses its kinetic energy and falls downwardly due to gravity and the friction with the exhaust gas as the grain size of the fluidizing medium is too large (approximately 1 mm) to be carried with the air flow.

In the case where the surface of the fluidizing bed is higher than the upper end of the inclined partition wall, a part of the fluidizing air gathered by the partition walls is injected along the deflecting partition wall toward a certain direction in such a manner similar to that in the circulating fluidized bed incinerator, while the other part, due to a sudden boiling phenomenon derived from the explosion of bubbles, is boiled upwardly like f ire works just above the upper end of the inclined partition wall and falls over all around the periphery. Accordingly, a part of the fluidizing medium is introduced in a large amount into the back side of the partition wall, i.e. the thermal energy recovery chamber.

That is, the moving direction of the injected fluidizing medium becomes closer to upright as the surface of the fluidizing bed becomes higher than the upper end of the inclined partition wall. Therefore, the amount of fluidizing medium introduced into the thermal energy recovery chamber becomes larger in the case where the surface of the fluidizing bed is slightly above the upper end of the inclined partition wall.

FIG. 4 shows the relationship between the amount of fluidizing air in the portion below the inclined partition wall in the primary fluidizing bed incinerating chamber and the amount of fluidizing medium circulated through the thermal energy recovery chamber.

For example, during the operation under the state Lj, if the height of the fluidized bed is lowered due to the scattering of the abraded fluidizing medium, the circulating amount of the fluidizing medium is suddenly reduced to, for example, below 1/10 of that of the former and thermal energy recovery cannot be performed. Thus, what is important is the amount of the fluidizing air and, in the case where it is arranged to be more than 4 Gmf and preferably more than 6 Gmf, the value of $G_1/G_0$ is maintained over 1 and the required and sufficient amount of the circulating fluidizing medium may be obtained even if the height of the fluidized bed is changed.

Further, by arranging the mass flow of the air injected from the air diffuser 22 in the bottom of the thermal energy recovery chamber to be 0–3 Gmf, or preferably 0–2 Gmf, and the mass flow of the fluidizing air injected from the air diffusion device 12 disposed below the inclined partition wall to be 4–20 Gmf or preferably 6–12 Gmf, that is, by always keeping the mass flow to be larger at the incinerating chamber side than at the thermal energy recovery chamber side, the amount of fluidizing medium fed back to the primary fluidized bed incinerating chamber from the thermal energy recovery chamber may be regulated.

As to the moving bed in the thermal energy recovery chamber, it is referred to in the academic sense as a static bed when the mass flow is 0–1 Gmf and a fluidized bed when the mass flow is over 1 Gmf, and it is commonly known that a minimum mass flow of 2 Gmf is required to form a stable fluidized bed. On the other hand, in the case of the moving bed according to the present invention, which is always descending and moving, the descending moving bed is satisfactorily formed until the mass flow is increased up to the order of about 1.5–2 Gmf without causing the destruction of the moving bed by the bubbling phenomenon. It is assumed that the grains of the fluidizing medium gradually descend and move under a vibrating mode whereby the fluidizing air is converted into small air bubbles uniformly flowing upward towards the upper portion of the moving bed.

Figure 7:
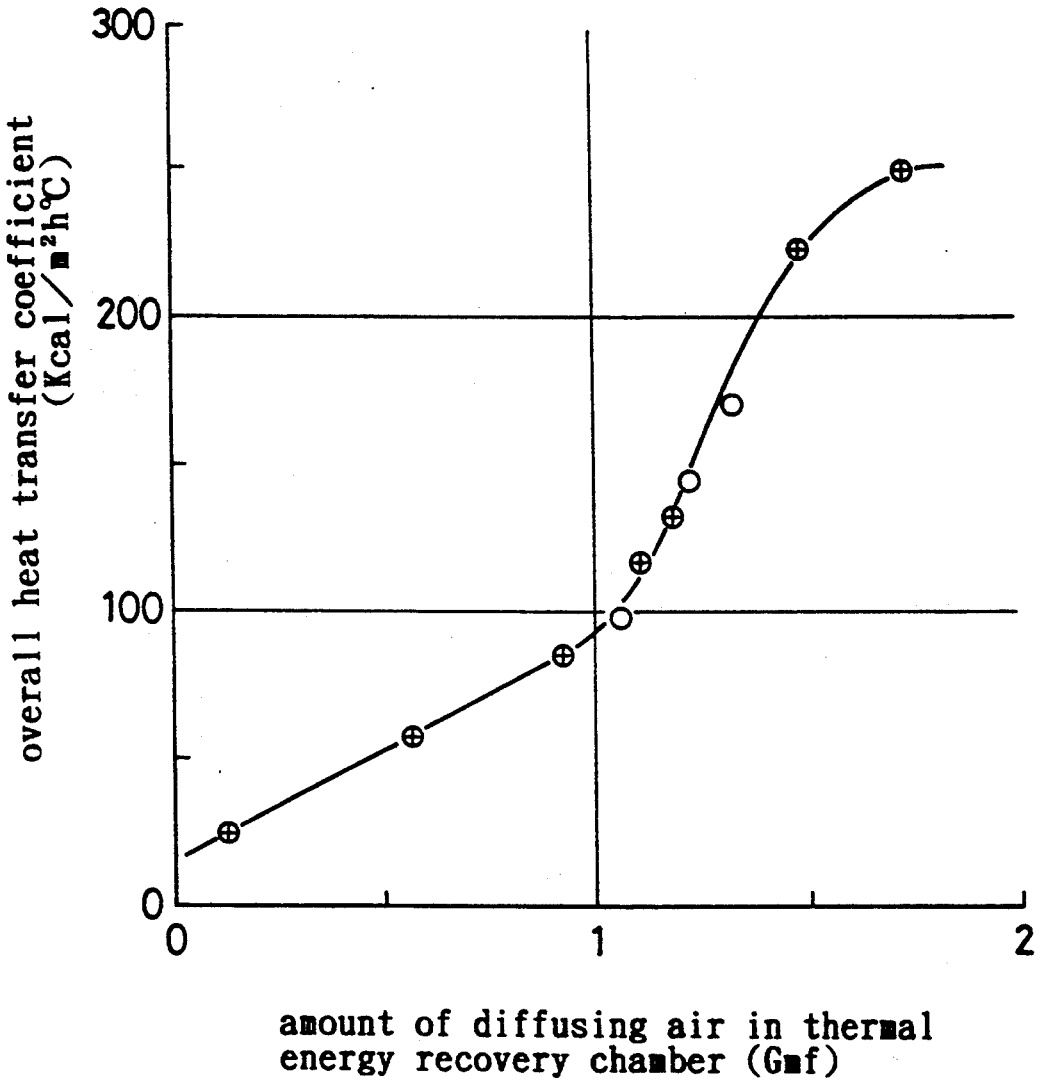
FIG. 7 is a graph showing the relationship between the diffusion mass flow (Gmf) in the thermal energy recovery chamber and the overall heat transfer coefficient in the pressurized internal circulating fluidized-bed boiler according to the present invention.

The heat transfer coefficient in the thermal energy recovering portion is greatly varied as shown in FIG. 7 when the amount of the diffusing air in the thermal energy recovery chamber is changed in the range of 0–2 Gmf.

Now the characteristics such as the load response characteristics caused by the formation of the moving bed in the thermal energy recovery chamber will be explained.

Figure 6:
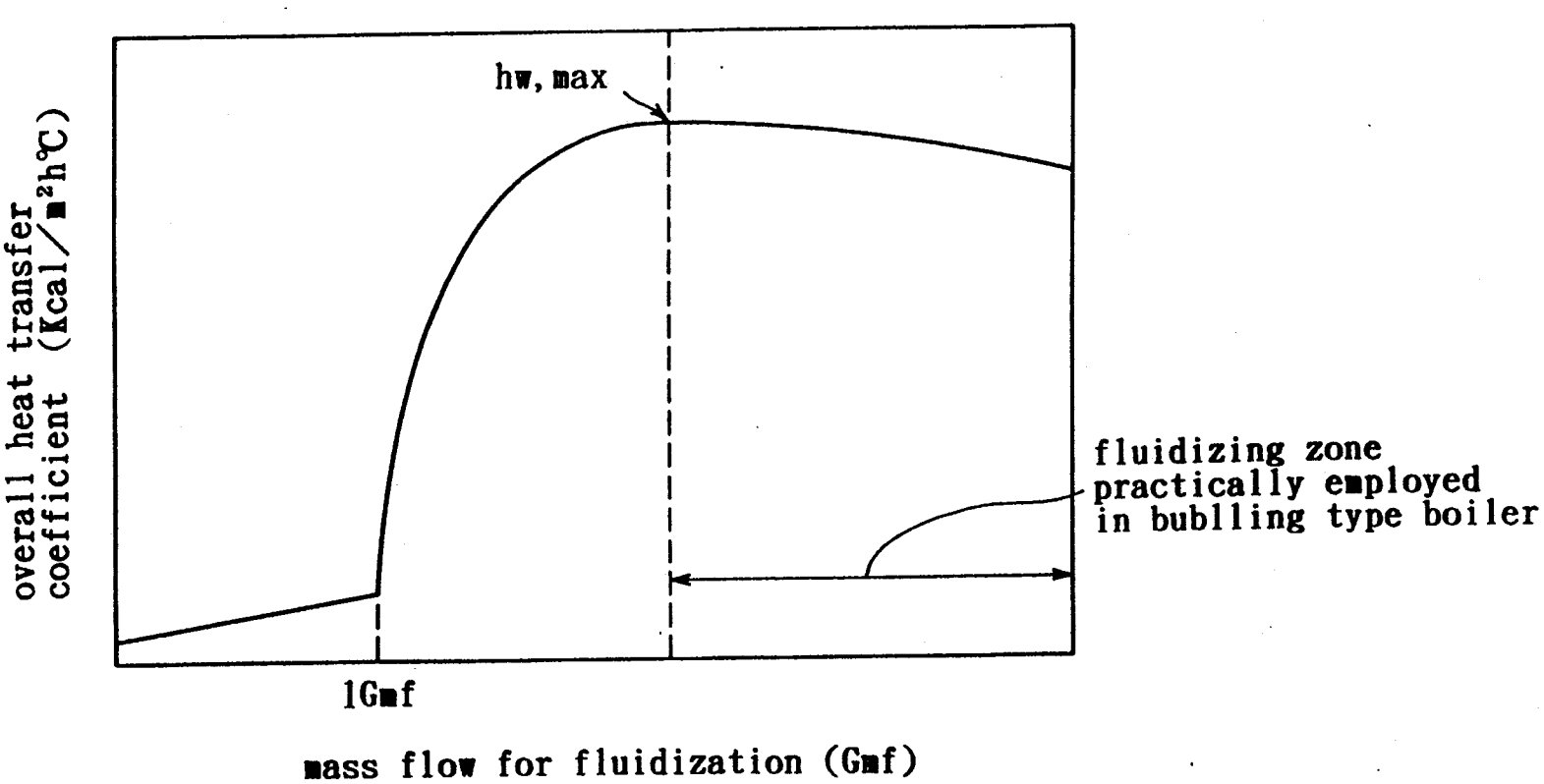
FIG. 6 is a graph showing the relationship between the mass flow for fluidization (Gmf) and the overall heat transfer coefficient in the conventional bubbling type boiler.

The general relationship between the overall heat transfer coefficient and the mass flow for fluidization is shown in FIG. 6. Between the values of the mass flow in the range of 0–1 Gmf, the increase in the heat transfer coefficient is small. The heat transfer coefficient suddenly increases when the mass flow becomes over 1 Gmf. As a method for turning down the fluidized bed boiler utilizing the above phenomenon, the "Wing Panel Type" is disclosed in DOE Report, 6021 (2), 655–663 (1985) and the heat transfer coefficient in response to the variation of the fluidizing mass flow is described to be insensitive (static bed) or too sensitive (fluidized bed).

Incidentally, upon reviewing certain foreign patent specifications, several cases are found which seem to be similar to the present technology in the point that the incinerating chamber and the thermal energy recovery chamber are separated. However, all the partitions disclosed therein are provided in a vertical direction, and the fluidizing medium in the thermal energy recovery chamber is in the mode for being changed to the static bed and to the fluidizing bed, it being the static bed when the thermal energy recovery is small in amount and the fluidizing bed in which the medium is blown upwardly from the lower portion when the thermal energy recovery is large in amount. This is because it is difficult to produce a deflected flow with a vertically oriented partition as compared to the case where the partition is inclined. It is therefore inevitable in the vertically oriented partition that the fluidizing medium is arranged in both the incinerating chamber and the thermal energy recovery chamber to be in a fluidized state (similar to water) so that the fluidizing medium is caused to flow between the two chambers.

The relationship between the overall heat transfer coefficient and the mass flow for fluidization is shown in FIG. 7. As shown in FIG. 7, the overall heat transfer coefficient changes almost linearly and, thus, the amount of thermal energy recovered and the temperature of the primary fluidized bed incinerating chamber may be controlled optionally. Further, such control may be easily effected simply by regulating the amount of diffusing air in the thermal energy recovery chamber.

Figure 8:
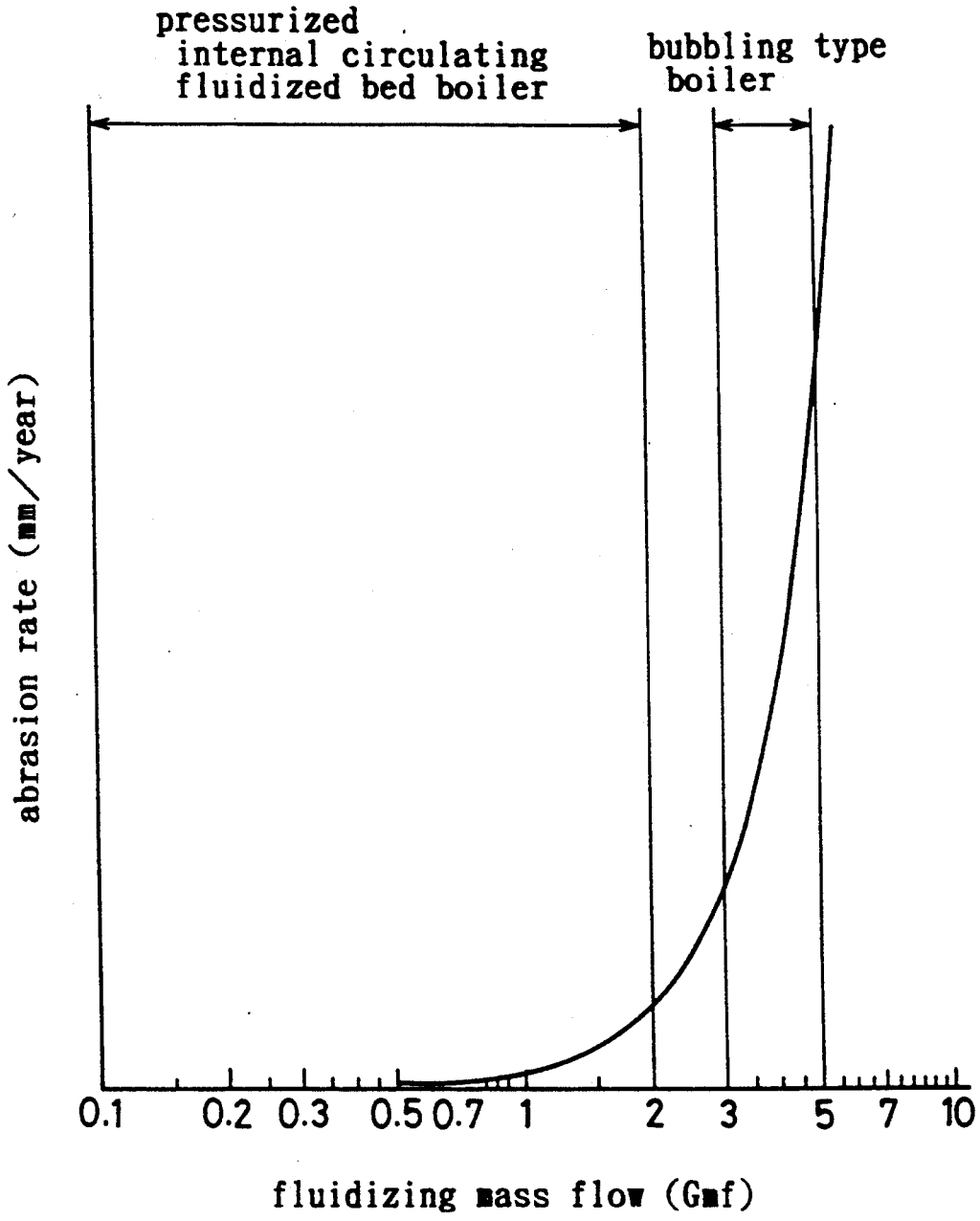
FIG. 8 is a graph showing the relationship between the mass flow for fluidization and the abrasion rate of the heat transfer tube.

Further, it is said that the abrasion rate of the heat transfer tubes in the fluidized bed is proportional to the cube of the mass flow for fluidization and such relationship is shown in FIG. 8. Accordingly, the problem of abrasion regarding the heat transfer tubes may be solved by arranging the amount of diffusing air blown into the moving bed in the thermal energy recovery chamber to 0–3 Gmf or preferably 0–2 Gmf.

In order to regulate the amount of thermal energy recovered, regulation of the amount of circulating fluidizing medium is effected, as explained before, while effecting simultaneous regulation of the heat transfer coefficient. That is, in the case where the amount of dif fusing air in the thermal energy recovery chamber is increased, the amount of circulating fluidizing medium is increased and the heat transfer coefficient is simultaneously increased to greatly increase the amount of thermal energy recovered by synergistic effect of the two factors. From the viewpoint of the temperature of the fluidizing medium in the fluidized bed, the above corresponds to the effect of preventing the temperature of the fluidizing medium from being raised above the predetermined temperature.

As a means for introducing the diffusing air into the thermal energy recovery chamber 19, several means may be considered, but it is generally disposed on the bottom of the thermal energy recovery chamber 19 so as to effectively utilize the space in the thermal energy recovery chamber.

Further, in the air diffuser 22, the diffusing air from the nozzles 23*n* is injected toward the incinerating chamber so that the fluidizing medium can be easily introduced into the incinerating chamber.

The respective sizes of the nozzles are preferably determined so that an approximately uniform diffusing amount is injected over the full length of the air diffuser 22 with the diffusing air amount being 2 Gmf. That is, when the above is satisfied, it is possible to obtain the maximum amount of thermal energy recovered by all the heat transfer surfaces in the thermal energy recovery chamber and the abrasion rate of the heat transfer surf aces may be kept small over all the surfaces.

In FIG. 3, a combustible charge inlet 26 is provided at the upper portion of the incinerator. Combustibles such as coal or petro coke are supplied to the combustor 2 through the combustible charge inlet 26 by a pneumatic conveyor (not shown).

Next, operation of the pressurized internal circulating fluidized-bed boiler thus constructed will be described below.

The combustibles F charged through the combustible charge inlet 26 are circulated and combusted in the fluidizing medium which is circulated under the influence of the circulating flow caused by the fluidizing air. At this time, the fluidizing medium at the central portion B above the air diffusion device 12 is not accompanied by a violent up-and-down motion thereof and forms a descending moving bed which is in a weak fluidizing state. The width of this moving bed is narrow at the upper portion thereof and the trailing ends thereof are extended in the opposite directions to reach the portions above both side portions A, C of the air diffusion device 12, thus the fluidizing medium is subjected to the fluidizing air injected at a greater mass flow f rom both side portions A, C and is blown upwardly. Accordingly, a portion of each trailing end is displaced and, thus, the bed just above the central portion B descends under gravity. Above this bed, the fluidizing medium piles up by being supplemented from the fluidizing bed, as explained later, and the fluidizing medium above the air diffusion device 12 forms a gradually and continuously descending moving bed with the repetition of the above modes.

The fluidizing medium moved above both side portions A, C is blown upwardly and deflected and whirled by the inclined partition walls 18*b* towards the center of the incinerator and falls on the top of the central moving bed and is circulated again as explained before. A part of the fluidizing medium is introduced into the thermal energy recovery chambers 19 beyond the upper portions of the inclined partition walls 18*b*. In the case where the descending rate of the fluidizing medium in the thermal energy recovery chamber 19 is slow, the angle of repose for the fluidizing medium is formed at the upper portion of the thermal energy recovery chamber and the excess fluidizing medium falls from the upper portion of the inclined partition wall 18*b* to the primary fluidized bed incinerating chamber.

The fluidizing medium introduced into the thermal energy recovery chamber 19 forms a gradually descending moving bed due to the gas injected from the air diffuser 22 and it is returned to the primary fluidized bed incinerating chamber from the opening portion 24 after the heat transfer is effected with the heat transfer tubes.

The mass flow of the diffusing air introduced from the air diffuser 22 in the thermal energy recovery chamber 19 is selected from values in the range of 0–3 Gmf or preferably 0–2 Gmf.

The reason for the above is that, as shown in FIG. 7, the heat transfer coefficient varies from the minimum to the maximum below the value of 2 Gmf and the abrasion rate can be controlled, as shown in FIG. 8, within a small range.

Further, the thermal energy recovery chamber is located outside the strong corrosive zone of the primary fluidized bed incinerating chamber under the reducing atmospheres and, thus, the heat transfer tubes 4 are subjected to less corrosion as compared to the conventional ones and the degree of abrasion of the heat transfer tubes 4 is made quite small because the fluidizing rate in this section is, as explained before, low. As to the speed of air f low in the fluidizing air with mass flow ranging 0–2 Gmf, it is 0–0.4 m/sec (superficial velocity) at 800° C. which is quite low while it practically depends on the temperature and grain size of the fluidizing medium.

Regarding the heat transfer in the thermal energy recovery chamber 19, in addition to the heat transfer that takes place due to the direct contact between the fluidizing medium and the heat transfer tubes 4, there is another form of heat transfer that utilizes the rising gas moving upwardly with irregular vibration as the fluidizing medium moves. In the latter case, there is substantially no boundary layer between the solid articles checking or preventing the heat transfer, in contrast to the ordinary heat transfer due to contact between gas and solid articles, and the fluidizing medium is well agitated so that the heat transfer within the grains of the fluidizing medium may be negligible. In general, the heat transfer cannot be disregarded in the case where the medium is stationary. Therefore, quite substantial heat transfer characteristics may be obtained. Accordingly, in the thermal energy recovery chamber according to the present invention, it is possible to obtain a large heat transfer coefficient almost equal to five times of the conventional incinerating gas boiler.

As explained above, the heat transfer phenomenon that occurs between the fluidizing medium and the heat transfer surfaces largely depends on the strength or weakness of the fluidization, and the amount of circulating fluidizing medium can be controlled by regulating the amount of gas introduced from the air diffuser 22. Also, by arranging the thermal energy recovery chamber 19 with its moving bed to be independent from the primary incinerating chamber within the incinerator, it is possible to construct a compact thermal energy recovery apparatus in which the turning down ratio is large and the fluidized bed may be easily controlled.

As mentioned above, heat generated in the incinerating chamber is recovered by the heat transfer tubes 4 in the thermal energy recovery chamber 19 to thus generate steam. The steam turbine 5 is driven by the steam and the generator coupled thereto is driven to generate electricity (see FIG. 1).

On the other hand, the exhaust gas is discharged from the upper portion of the boiler and passes through the multistage dust collector 8, and then the exhaust gas drives the gas turbine 9. The gas turbine 9 drives the compressor 3 and the generator to thus generate electricity.

Particles including ash, char, lime or the like are returned to the free board of the combustor 2 and recirculated in the incinerating chamber.

The NOx content and smoke dust in the exhaust gas emitted from the outlet of the gas turbine 9 are reduced, if necessary. The waste heat of the exhaust gas is then recovered by the economizer 7. Thereafter, the exhaust gas is discharged from the smoke stack 10.

Boilers which employ a fuel such as coal or petro coke that is combusted at a low combustion rate are often able to vary the amount of steam only at a rate commensurate with the combustion rate even though quicker variation of the amount of steam is desirable. In this regard, bubbling boilers are less capable than such boilers because they recover thermal energy through the temperature of the fluidized bed.

According to the present invention, however, the amount of heat transferred in the thermal energy recovery chamber can instantaneously be made several times larger or smaller by varying the amount of air diffused into the thermal energy recovery chamber. Though varying the amount of heat generated in the fluidized bed by varying the amount of fuel supplied thereto suffers a time lag as it is governed by the combustion rate, the amount of thermal energy recovered from the fluidizing medium in the thermal energy recovery chamber can quickly be varied by controlling the amount of air diffused into the thermal energy recovery chamber. The difference between the response rates of changes in the amount of heat generated in the fluidized bed and the amount of thermal energy recovered from the fluidizing medium can be absorbed as a temporary change in the temperature of the fluidizing medium by the sensible heat storage ability of the fluidizing medium which forms the fluidized bed. Consequently, the pressurized internal circulating fluidized-bed boiler according to the present invention can utilize thermal energy without wasting it, and is capable of controlling the amount of steam with a good response which conventional coal-burning boilers have failed to accomplish.

The fluidizing air diffusion device 12 is shown as being of the roof-shaped structure in FIG. 3. Since, however, swirling flows can be created in the primary incinerating chamber by the inclined partition wall if the amount of fluidizing air ejected from the nozzles 12*n* of the side portions A, C of the fluidizing air diffusion device 12 is 4 Gmf or more, the fluidizing air diffusion device 12 may extend horizontally when burning combustibles such as coal with a small incombustible content.

The pressurized internal circulating fluidized-bed boiler according to the present invention, therefore, has a high thermal energy recovery capability. A process of controlling the pressurized internal circulating fluidized-bed boiler according to the present invention will be described below.

According to the present invention, the amount of thermal energy recovered in the thermal energy recovery chamber is controlled by controlling the amount of a gas or air ejected from the air diffuser into the thermal energy recovery chamber, and the temperature in the primary incinerating chamber is controlled by controlling the amount of charged fuel based on the temperature in the primary incinerating chamber or the pressure of steam. Inasmuch as the pressurized internal circulating fluidized-bed boiler allows the thermal transfer coefficient to be adjusted as desired and a change in the amount of recovered thermal energy can be absorbed as a change in the sensible heat of the fluidizing medium, the pressurized internal circulating fluidized-bed boiler can respond immediately to a change in the load and hence can operate stably.

As shown in FIG. 3, if the temperature of steam drawn from the heat transfer tubes 4 is insufficient, then a valve 43 on the conduit 21 coupled to the air diffuser 22 is opened by a valve opening controller 42 based on the temperature detected by a temperature detector 41 on a steam outlet pipe 40 connected to the heat transfer tubes 4. Thus, the amount of air diffused into the thermal energy recovery chamber 19 is increased to increase the amount of recovered thermal energy for raising the steam temperature up to a temperature corresponding to a load that the boiler is required to bear.

The temperature of the fluidized bed is detected by a temperature sensor 44. Based on the temperature detected by the temperature sensor 44, the amount of fuel supplied into the primary incinerating chamber and/or the amount of air supplied to the nozzles 12*n* is controlled to control the temperature in the primary incinerating chamber within a predetermined range.

Alternatively, since when the amount of steam required varies due to a change in the load, the pressure of steam varies mostly quickly in response to the amount of steam, the amount of fuel supplied to the primary incinerating chamber can be controlled according to a pressure signal indicative of the pressure of steam.

Figure 9:
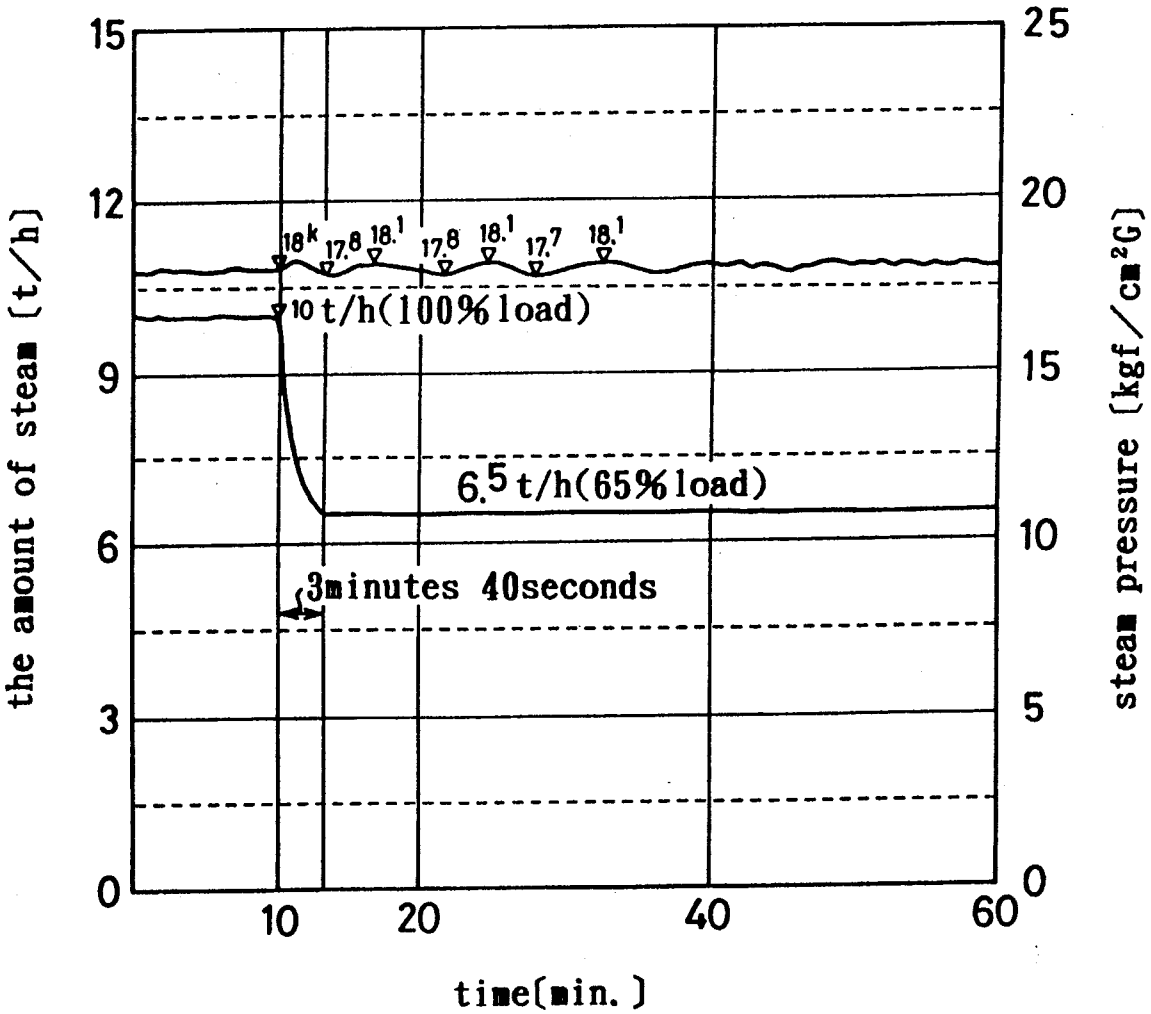
FIG. 9 is a graph showing variations relative to the lapse of time in the steam amount and steam pressure in response to stepwise change of the steam flow rate.
Figure 10:
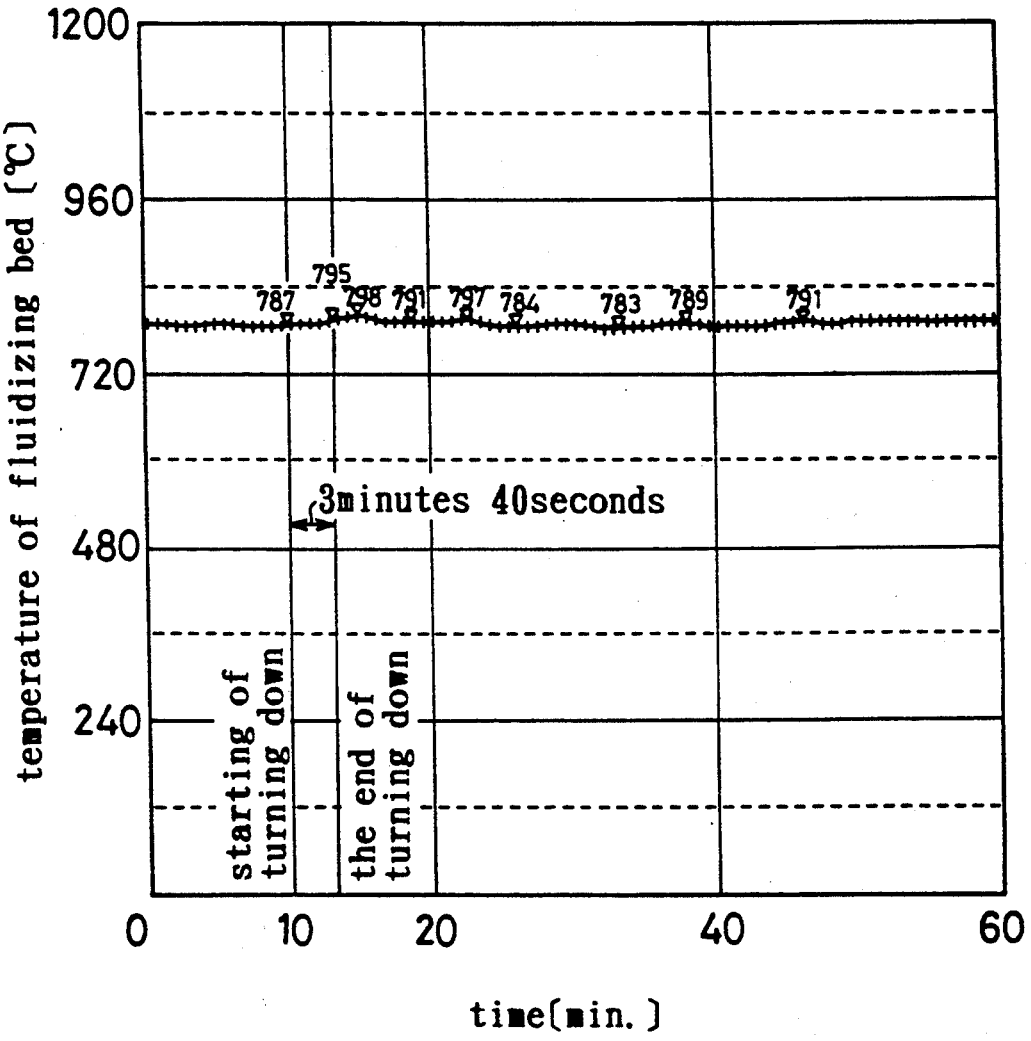
FIG. 10 is a graph showing variations relative to the lapse of time in temperature of the fluidized bed.

The response characteristics of the boiler at the time the amount of steam varied stepwise from 100% to 65% are shown in FIGS. 9 and 10.

FIG. 9 shows the amount of steam and the pressure of steam as they vary, and FIG. 10 shows the temperature of the fluidized bed as it varies. As can be seen from FIG. 9, the amount of steam varied quickly, i.e., varied from 100% of the load to 75% of the load in about 1 minute, and became stable as a whole in 3 minutes and 40 seconds. During this time, the pressure of steam only varied within a range of from +0.1 to −0.3 kg/cm$^2$. The temperature of the fluidized bed only varied in a range of from +11° C. to −3° C., and became stable at +4° C. in about 20 minutes as shown in FIG. 10. The graphs of FIGS. 9 and 10 indicate that the control process according to the present invention is quick in response and stable in control.

Figure 11:
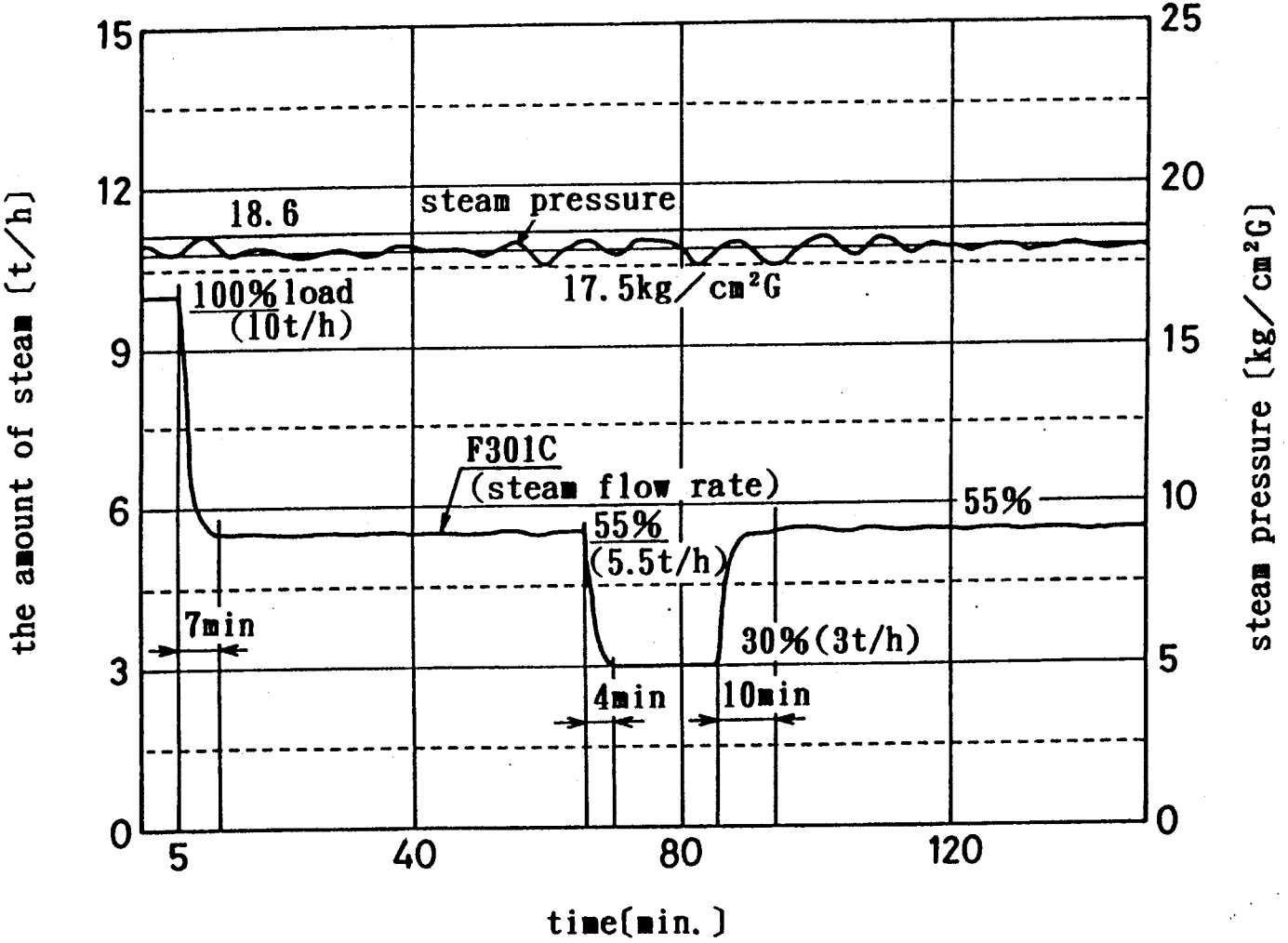
FIG. 11 shows similar variations relative to the lapse of time in response to continuously stepwise change of the steam flow rate.

FIG. 11 illustrates the response characteristics of the boiler at the time the amount of steam varied stepwise from 100% to 55% to 30% to 55%. Study of FIG. 11 also indicates that the control process also achieves quick response and stable control.

The present invention offers various advantages as described below.

Since the incinerating chamber and the thermal energy recovery chamber are functionally separated from each other within the combustor, the boiler can be controlled to meet a load simply by varying the overall heat transfer coefficient of the heat transfer tubes through adjustment of the amount of air introduced into the thermal energy recovery chamber, rather than by varying the height of the fluidized bed in the incinerating chamber. Therefore, no complex process and equipment, i.e., a bed material storage container, is necessary to take the fluidizing medium into and out of the incinerating chamber and the thermal energy recovery chamber, and no agglomeration is generated as the fluidizing medium flows into and out of the incinerating chamber and the thermal energy recovery chamber. Since the temperature of the fluidized bed is kept at a constant level even when the load on the boiler varies, the boiler can be operated under a temperature condition optimum for the suppression of NOx, SOx, and other undesirable emissions. Inasmuch as the heat transfer tubes are positioned only in the thermal energy recovery chamber in which there exists a gradual flow of the fluidizing medium, the heat transfer tubes are less subject to wear than would be if they were placed in the fluidized bed which is in a violent flow condition.

As swirling flows are developed in the fluidized bed, the fluidizing medium does not stay stagnant in the fluidized bed, and the fuel such as coal, petro coke, or the like is uniformly dispersed and combusted, with no agglomeration produced. The amount of carbon monoxide produced is kept low because the exhaust gas emitted from the fluidized bed is not cooled by the heat transfer tubes in the fluidized bed. The boiler lends itself to a wide variety of different coal types because it is expected to have a high combustion efficiency with respect to coals with a high fuel ratio. The process of charging a fuel such as coal into the incinerating chamber may be simplified as the charged coal is quickly dispersed.

The denitrification unit may be dispensed with if ash, char, fine lime particles or the like collected from the exhaust gas emitted from the outlet of the combustor are returned to a free board section of the combustor. Furthermore, limestone employed for desulfurization in the combustor can be utilized at a high utilization ratio for a high desulfurization rate.

What is claimed is:

1. A pressurized internal circulating fluidized-bed boiler for use in a combined-cycle electric generating system, comprising:

a pressure vessel;

a combustor disposed in said pressure vessel;

a primary fluidized bed incinerating chamber having an air diffusion device provided at the bottom of said combustor and adapted to inject fluidizing air upwardly under a mass flow that is at least greater at one side than that at another side;

an inclined partition wall provided above a portion of said air diffusion device where the mass flow is greater so as to interfere with the upward flow of the fluidizing air and thereby to deflect the air towards a portion above said another side of said air diffusion device where the mass flow is smaller;

a thermal energy recovery chamber partitioned from said primary incinerating chamber by said inclined partition wall;

a heat transfer surface means provided in said thermal energy recovery chamber for a passage of a heat receiving fluid therethrough; and an air diffuser provided at a lower portion of said thermal energy recovery chamber;

wherein said thermal energy recovery chamber is communicated at upper and lower portions thereof with said primary fluidized bed incinerating chamber, a moving bed is formed above the portion of said air diffusion device where the injected mass flow is smaller so that a fluidizing medium descends and diffuses within the moving bed, and a circulating fluidized bed is formed above the portion of said air diffusion device where the mass flow of the fluidizing air is greater so that said fluidizing medium is actively fluidized and whirled towards a position above said moving bed and a part of said fluidizing medium is introduced into said thermal energy recovery chamber beyond an upper portion of said inclined partition wall, the formation of said moving bed and said circulating fluidized bed is effected by regulation of the amount of air injected upwardly from said air diffusion device and regulation of the fluidizing air injected from said air diffuser in said thermal energy recovery chamber causes the fluidizing medium within said recovery chamber to descend in a state of a moving bed for circulation.

2. The pressurized internal circulating fluidized-bed boiler according to claim 1, further comprising a second air diffuser mounted on said inclined partition wall in an upper portion of said thermal energy recovery chamber, for diffusing air to combust, agitate, and diffuse a fuel that has entered said thermal energy recovery chamber, said second air diffuser being positioned remotely from said heat transfer surface means.

3. The pressurized internal circulating fluidized-bed boiler according to claim 1, wherein said air diffuser is inclined progressively downwardly toward said primary incinerating chamber for directing the fluidizing medium from said thermal energy recovery chamber into said primary incinerating chamber.

4. The pressurized internal circulating fluidized-bed boiler according to claim 1, wherein said air diffuser is directed to orient the air toward said primary incinerating chamber for directing the fluidizing medium from said thermal energy recovery chamber into said primary incinerating chamber.

5. The pressurized internal circulating fluidized-bed boiler according to claim 1, further comprising a dust collector for collecting dust particles from an exhaust gas emitted from said combustor and returning the collected dust particles to a free board section of said combustor.

6. The pressurized internal circulating fluidized-bed boiler according to claim 1, wherein said inclined partition wall is inclined by 10°–60° relative to the horizontal and the projection length (l) thereof in the horizontal direction is 1/6–½ of the horizontal length (L) of a bottom of the incinerator.

7. The pressurized internal circulating fluidized-bed boiler according to claim 1, wherein the mass flow of the air injected from said air diffuser at the bottom of said thermal energy recovery chamber is in the range of 0–3 Gmf, and the mass flow of the fluidizing air injected from said air diffusion device below said inclined partition wall is in the range of 4–20 Gmf.

8. The pressurized internal circulating fluidized-bed boiler according to claim 1, wherein said inclined partition wall is inclined by 25°–45° relative to the horizontal.

9. The pressurized internal circulating fluidized-bed boiler according to claim 1, wherein said inclined partition wall is inclined by approximately 35° relative to the horizontal.

10. The pressurized internal circulating fluidized-bed boiler according to claim 1, wherein said inclined partition wall is formed such that said projection length (l) in the horizontal direction is ¼–½ of the horizontal length (L) of said bottom of said incinerator.

* * * * *